US010464362B2

(12) United States Patent
Matsumori et al.

(10) Patent No.: US 10,464,362 B2
(45) Date of Patent: Nov. 5, 2019

(54) THERMOSENSITIVE RECORDING MEDIUM

(71) Applicant: Nippon Paper Industries Co., Ltd., Tokyo (JP)

(72) Inventors: Yasuaki Matsumori, Tokyo (JP); Akihito Ogino, Tokyo (JP); Kenji Hirai, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 15/770,053

(22) PCT Filed: Oct. 19, 2016

(86) PCT No.: PCT/JP2016/080926
§ 371 (c)(1),
(2) Date: Apr. 20, 2018

(87) PCT Pub. No.: WO2017/069141
PCT Pub. Date: Apr. 27, 2017

(65) Prior Publication Data

US 2018/0311987 A1 Nov. 1, 2018

(30) Foreign Application Priority Data

Oct. 23, 2015 (JP) ..... 2015-208590

(51) Int. Cl.
*B41M 5/323* (2006.01)
*B41M 5/30* (2006.01)
*B41M 3/14* (2006.01)
*B41M 5/41* (2006.01)
*B41M 5/333* (2006.01)

(52) U.S. Cl.
CPC ..... *B41M 5/323* (2013.01); *B41M 3/142* (2013.01); *B41M 5/30* (2013.01); *B41M 5/305* (2013.01); *B41M 5/3333* (2013.01); *B41M 5/3335* (2013.01); *B41M 5/41* (2013.01)

(58) Field of Classification Search
CPC ..... B41M 5/30; B41M 5/305; B41M 5/41; B41M 3/142
See application file for complete search history.

(56) References Cited

U.S. PATENT DOCUMENTS

| | | | | |
|---|---|---|---|---|
| 3,297,447 | A * | 1/1967 | McVeigh | G03C 1/09 430/543 |
| 8,129,307 | B2 | 3/2012 | Makihara et al. | |
| 8,247,347 | B2 | 8/2012 | Takagi et al. | |
| 8,283,284 | B2 | 10/2012 | Hirai et al. | |
| 8,466,085 | B2 | 6/2013 | Kato et al. | |
| 8,492,308 | B2 | 7/2013 | Kurihara et al. | |
| 8,609,582 | B2 | 12/2013 | Hirai et al. | |
| 8,673,812 | B2 | 3/2014 | Ohse et al. | |
| 8,722,576 | B2 | 5/2014 | Hayakawa et al. | |
| 9,579,916 | B2 | 2/2017 | Matsumori et al. | |
| 2004/0156951 | A1* | 8/2004 | van Krieken | A21D 2/14 426/39 |
| 2010/0099557 | A1* | 4/2010 | Makihara | B41M 5/3335 503/207 |
| 2011/0269622 | A1 | 11/2011 | Ohse et al. | |
| 2017/0129266 | A1 | 5/2017 | Ogino et al. | |
| 2018/0178570 | A1 | 6/2018 | Matsumori et al. | |
| 2018/0311987 | A1* | 11/2018 | Matsumori | B41M 5/323 |

FOREIGN PATENT DOCUMENTS

| | | | |
|---|---|---|---|
| EP | 2033799 | A1 | 3/2009 |
| JP | S52-106907 | A | 9/1977 |
| JP | 52-123710 | A | 10/1977 |
| JP | S58011193 | A | 1/1983 |
| JP | 58-082788 | | 5/1983 |
| JP | S60-101171 | A | 11/1983 |
| JP | S59-33189 | A | 2/1984 |
| JP | 3-288692 | A | 12/1991 |
| JP | 7-179037 | A | 7/1995 |
| JP | H08-59603 | A | 3/1996 |
| JP | 10-217615 | | 8/1998 |
| JP | 10-258577 | A | 9/1998 |
| JP | 11-272133 | A | 10/1999 |
| JP | 2000-143611 | A | 5/2000 |
| JP | 2000-168239 | A | 6/2000 |
| JP | 2001-310561 | A | 11/2001 |
| JP | 2001-347757 | A | 12/2001 |

(Continued)

OTHER PUBLICATIONS

Office Action corresponding to U.S. Appl. No. 15/735,048 dated Jun. 6, 2019.
Machine translation of detailed description of JP 2003-266946 acquired on Jun. 2, 2019.
Extended European Search Report corresponding to European Patent Application No. 16811689.5 dated Feb. 4, 2019.
Extended European Search Report corresponding to European Patent Application No. 16857454.9 dated Oct. 4, 2018.
International Search Report and Written Opinion of the International Searching Authority corresonding to international application PCT/JP2016/067901 dated Aug. 23, 2016.
IPRP with Written Opinion and International Search Report corresponding to International Application No. PCT/JP2016/080926 dated Apr. 24, 2018.

(Continued)

*Primary Examiner* — Betelhem Shewareged
(74) *Attorney, Agent, or Firm* — Jenkins, Wilson, Taylor & Hunt, P.A.

(57) ABSTRACT

As a thermosensitive recording medium utilizes a coloring reaction between a colorless or pale colored electron donating leuco dye and an electron accepting color developing agent, a thermosensitive recording medium using an environment-friendly color developing agent is provided. Provided is a thermosensitive recording medium having a thermosensitive recording layer comprising a colorless or pale colored electron donating leuco dye and an electron accepting color developing agent on a substrate, wherein the thermosensitive recording layer comprises a gluconolactone as the electron accepting color developing agent.

10 Claims, No Drawings

(56) References Cited

FOREIGN PATENT DOCUMENTS

| | | | |
|---|---|---|---|
| JP | 2002-178645 | A | 6/2002 |
| JP | 2002-178646 | A | 6/2002 |
| JP | 2002-301873 | A | 10/2002 |
| JP | 2003-072246 | A | 3/2003 |
| JP | 2003-154760 | A | 5/2003 |
| JP | 2003-165276 | A | 6/2003 |
| JP | 2003-266946 | | 9/2003 |
| JP | 3635399 | B2 | 4/2005 |
| JP | 2005-280107 | A | 10/2005 |
| JP | 2006-264255 | A | 10/2006 |
| JP | 2007-125744 | A | 5/2007 |
| JP | 2013199054 | A | 10/2013 |
| JP | 6211744 | B2 | 9/2017 |
| WO | WO 97/16420 | A1 | 5/1997 |
| WO | WO 00/14058 | A1 | 3/2000 |
| WO | WO 02/081229 | A1 | 10/2002 |
| WO | WO 2004/002748 | A1 | 10/2005 |
| WO | WO2014/143174 | A1 | 9/2014 |
| WO | WO 2016/204215 | A1 | 12/2016 |

OTHER PUBLICATIONS

Notice of Rejection Reason corresponding to Japanese Patent No. 6211744 dated Jul. 11, 2018.

Notification of Transmittal of IPRP with Written Opinion corresponding to International Application No. PCT/JP2016/067901 dated Dec. 28, 2017.

Office Action corresponding to U.S. Appl. No. 15/735,048 dated Jan. 4, 2019.

Notice of Allowance corresponding to U.S. Appl. No. 15/735,048 dated Aug. 7, 2019.

* cited by examiner

THERMOSENSITIVE RECORDING MEDIUM

FIELD OF THE INVENTION

The present invention relates to a thermosensitive recording medium for recording image by utilizing a coloring reaction between a colorless or pale colored electron donating leuco dye (referred to as "leuco dye") and an electron accepting color developing agent (referred to as "color developing agent"), wherein the thermosensitive recording layer comprises a gluconolactone as the electron accepting color developing agent.

BACKGROUND OF THE INVENTION

Thermosensitive recording media are ordinarily prepared by applying a coating solution containing a leuco dye and an color developing agent onto a substrate such as paper, synthetic paper, film, plastic and the like. Thermosensitive recording medium develops color through an instantaneous chemical reaction when heated using a thermal head, hot stamp, hot pen, laser light and the like and yields a recorded image. Thermosensitive recording media are used extensively in recording media such as facsimile devices, computer terminal printers, automatic ticket dispensers, recorders for meters, receipts at super markets and convenience stores and the like.

As the color developing agent, bisphenols, alkylphenols, novolac type phenolic resins, derivatives of aromatic carboxylic acids and metal salts thereof, hydroxybenzoic acid esters, sulfonylurea compounds, activated clay, and the like are generally used.

There's a demand from the users of thermosensitive recording media for an environment-friendly color developing agent rather than such a conventional phenol type material and the like. Then thermosensitive recording media using ascorbic acid (References 1 and 2, etc.), saccharin (Reference 3 etc.) and the like as the color developing agent has been disclosed.

REFERENCES

Reference 1: Japanese Patent Application Public Disclosure S60-101171
Reference 2: International Publication WO2014/143174
Reference 3: Japanese Patent Application Public Disclosure S59-33189

Problems to be Solved by the Invention

It is an object of the present invention to provide a thermosensitive recording medium using an environment-friendly color developing agent.

Means to Solve the Problems

In order to solve the above problem, the present inventors have studied a wide range of environment-friendly compounds and, as a result, surprisingly found that a gluconolactone functions as a color developing agent and completed the present invention.

That is, the present invention provides a thermosensitive recording medium having a thermosensitive recording layer comprising a colorless or pale colored electron donating leuco dye and an electron accepting color developing agent on a substrate, wherein the thermosensitive recording layer comprises a gluconolactone as the electron accepting color developing agent.

DETAILED DESCRIPTION OF THE INVENTION

Gluconolactone (also referred to as glucono-1,5-lactone or glucono-δ-lactone) used as a color developing agent in the present invention is represented by the following formula (formula 1) and is a lactone of a gluconic acid obtained by oxidizing a glucose, and in vivo it is obtained by converting a glucose by the action of glucose-1-dehydrogenase.

(formula 1)

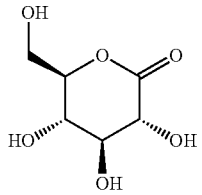

Gluconolactone is being used as a natural additive for foods and is safe to the human body.

It is considered that gluconolactone is in equilibrium with gluconic acid in a solution such as a coating solution and is in the state of gluconolactone with the above formula in a coating solution (dry state). In the present invention, the compounds in these states are collectively referred to as gluconolactone.

As gluconolactone that is environment-friendly is used as a color developing agent in the present invention, any color developing agent other than gluconolactone may be used in combination, which may bring better effects on the function of a thermosensitive recording medium, such as color developing performance (print intensity) and the like. However, when a color developing agent other than gluconolactone is used in combination, the advantage of being environment-friendly may decrease according to the ratio.

As such color developing agents, activated clay, attapulgite, colloidal silica, inorganic acidic substances such as aluminum silicate and the like, 4,4'-isopropylidene diphenol, 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, 1-[4-(4-hydroxyphenyl-sulfonyl) phenoxy]-4-[4-(4-isopropoxyphenyl sulfonyl) phenoxy] butane, phenol condensate composition described in Japanese Patent Application Public Disclosure No. 2003-154760, aminobenzene sulfonamide derivatives described in Japanese Patent Application Public Disclosure No. H08-59603, bis(4-hydroxyphenyl thioethoxy) methane, 1,5-di(4-hydroxyphenyl thio)-3-oxapentane, butyl bis(p-hydroxyphenyl) acetate, methyl bis(p-hydroxyphenyl) acetate, 1,1-bis(4-hydroxyphenyl)-1-phenyl ethane, 1,4-bis[α-methyl-α-(4'-hydroxyphenyl)ethyl] benzene, 1,3-bis[α-methyl-α-(4'-hydroxyphenyl)ethyl] benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino] salicylate dihydrate, 4-[2-(p-methoxyphenoxy) ethyloxy] salicylic acid, 4-[3-(p-trisulfonyl) propyloxy] salicylic acid, aromatic carboxylic acids such as 5-[p-(2-p-methoxyphenoxyethoxy) cumyl] salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited.

These color developing agents may be used individually and in mixtures of at least two.

1-[4-(4-hydroxyphenyl-sulfonyl) phenoxy]-4-[4-(4-isopropoxyphenyl sulfonyl) phenoxy] butane is available under the trade name of JKY-214 produced by Mitsubishi Chemical Corporation. The phenol condensate composition described in Japanese Patent Application Public Disclosure No. 2003-154760 is available under the trade name of JKY-224 produced by Mitsubishi Chemical Corporation. The diphenylsulfone crosslinked type compound described in International Publication WO97/16420 is available under the trade name of D-90 produced by Nippon Soda Co., Ltd. The compound described in International Publication WO02/081229 is also available under the trade names of NKK-395 and D-100 produced by Nippon Soda K.K. In addition, high molecular weight aliphatic acid metal complex salts described in Japanese Patent Application Public Disclosure No. H10-258577 and metal chelate type color development components such as polyvalent hydroxy aromatic compounds and the like may also be present.

Among these color developing agents, a color developing agent having a urea structure (—NHCONH—) is preferred as a color developing agent that may be used in combination with gluconolactone in the present invention, As such color developing agents, for example, the following color developing agents may be cited:

N-(2-(3-phenylureido) phenyl) benzenesulfonamide (represented by the following formula, for example, available as NKK 1304 manufactured by Nippon Soda Co., Ltd.)

(formula 2)

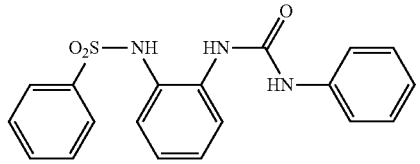

3-(3-Tosylureido) phenyl-p-toluenesulfonate (represented by the following formula, for example, available as DP 201 manufactured by BASF Japan Ltd.)

(formula 3)

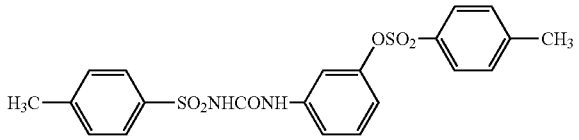

Urea urethane compound (represented by the following formula, for example, available as UU manufactured by Chemipro Kasei Kaisha, Ltd.)

(formula 4)

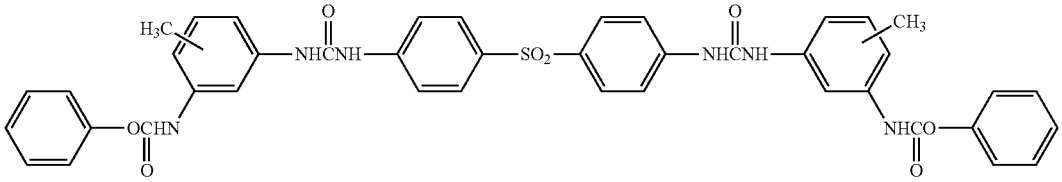

3-{[(Phenylamino) carbonyl] amino} benzenesulfonamide (represented by the following formula, for example, available as SU 727 manufactured by Mitsubishi Chemical Corporation)

(formula 5)

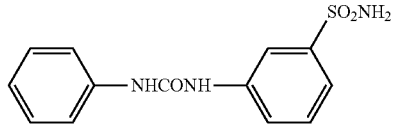

The amount (in solid) of gluconolactone in the thermosensitive recording layer is preferably from 1 to 18 weight %, more preferably from 3 to 14 weight %, further preferably from 5 to 10 weight %.

Also, it is preferable from the viewpoint of environment-friendliness that the color developing agent consists only of gluconolactone. However, when other color developing agents are used in combination by considering the balance between the influence on environment and the performance of a thermosensitive recording medium such as coloring performance (printing density), the weight ratio of gluconolactone to the other color developing agent (gluconolactone/other color developing agent) in the color developing agent is preferably 40/60 or more, more preferably from 50/50 to 80/20, further preferably from 50/50 to 70/30.

The conventional composition for the thermosensitive recording medium may be utilized for the thermosensitive recording medium of the present invention other than using gluconolactone as a color developing agent.

That is, the thermosensitive recording medium of the present invention essentially comprises a thermosensitive recording layer on a substrate and may optionally have a protective layer on the thermosensitive recording layer, a undercoat layer between the substrate and the thermosensitive recording layer, and a back coat layer on the opposite side of the thermosensitive recording layer of the substrate. And any other coating layer may appropriately be installed depending on the purpose of usage.

The substrate is not particularly limited, and can be appropriately selected from conventionally known substrates such as paper, recycled paper, synthetic paper, film, plastic film, foamed plastic film, nonwoven fabric or the like according to the desired quality of the thermosensitive recording medium. Further, any combination of these may be used as a substrate.

The thermosensitive recording layer of the present invention essentially comprises a leuco dye in addition to the above-described color developing agent, and may further optionally comprise a sensitizer, a binder, a pigment, a crosslinking agent, an image stabilizer and other components.

As the leuco dye in the present invention, all of the leuco dyes well known in the conventional field of pressure sensitive and thermosensitive recording media may be used. As the leuco dye is not particularly restricted, triphenylmethane type compounds, fluorane type compounds, fluorene type compounds, divinyl type compounds and the like are preferred as the leuco dye. Specific examples of the typical leuco dye (dye precursors) are shown below. In addition, these leuco dye precursors may be used individually and also in mixtures of at least two of them.

<Triphenylmethane Type Leuco Dyes>

3,3-bis(p-Dimethyl aminophenyl)-6-dimethylaminophthalide [alternate name: crystal violet lactone] and 3,3-bis(p-Dimethyl aminophenyl) phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benz[a] fluorane, 3-diethylamino-benz[c] fluorane, 3-dibutylamino-6-methylfluorane, 3-dibutylamino-6-methyl-7-anilino fluorane, 3-dibutylamino-6-methyl-7-(o,p-dimethylanilino) fluorane, 3-dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-o-(p-dimethylaminophenyl) aminoanilino fluorane, 2-methoxy-6-p-(p-dimethylaminophenyl) aminoanilino fluorane, 2-chloro-3-methyl-6-p-(p-phenylaminophenyl) aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p-(p-diethylaminophenyl) aminoanilino fluorane, 2-diethylamino-6-p-(p-diethylaminophenyl) aminoanilino fluorane, 2-phenyl-6-methyl-6-p-(p-phenylaminophenyl) aminoanilino fluorane, 2-benzyl-6-p-(p-phenylaminophenyl) aminoanilino fluorane, 2-hydroxy-6-p-(p-phenylaminophenyl)aminoanilino fluorane, 3-methyl-6-p-(p-dimethylaminophenyl) aminoanilino fluorane, 3-diethylamino-6-p-(p-diethylaminophenyl) aminoanilino fluorane, 3-diethylamino-6-p-(p-dibutylaminophenyl) aminoanilino fluorane and 2,4-dimethyl-6-[(4-dimethylamino) anilino] fluorane.

<Fluorene Type Leuco Dye>

3,6,6-Tris(dimethylamino) spiro[fluorane-9,3'-phthalide] and 3,6,6'-tris (diethylamino) spiro[fluorane-9,3'-phthalide].

<Divinyl Type Leuco Dyes>

3,3-bis-[2-(p-dimethylaminophenyl)-2-(p-methoxyphenyl) ethenyl]-4,5,6,7-tetrabromophthalide, 3,3-bis-[2-(p-dimethylaminophenyl)-2-(p-methoxyphenyl) ethenyl]-4,5,6,7-tetrachlorophthalide, 3,3-bis-[1,1-bis(4-pyrrolidinophenyl) ethylene-2-yl] 4,5,6,7-tetra-bromophthalide, 3,3-bis-[1-(4-methoxyphenyl)-1-(4-pyrrolidinophenyl) ethylene-2-yl]-4,5,6,7-tetrachlorophthalide <Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitroanilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

As the sensitizers used in the thermosensitive recording medium of the present invention, diphenylsulfone, aliphatic acid amides such as stearic acid amide, palmitic acid amide and the like, benzyloxy naphthalene, 1,2-di(3-methylphenoxy) ethylene, di(p-methylbenzyl) oxalate and the like may be listed as examples. These sensitizers may be used individually or as mixtures of at least two of them.

As the binder used in the present invention, polyvinyl alcohols such as completely saponified polyvinyl alcohol, partially saponified polyvinyl alcohol, carboxyl-modified polyvinyl alcohol, diacetone modified polyvinyl alcohol, acetoacetyl modified polyvinyl alcohol, amide-modified polyvinyl alcohol, sulfonic acid-modified polyvinyl alcohol, butyral-modified polyvinyl alcohol, olefin-modified polyvinyl alcohol, nitrile-modified polyvinyl alcohol, pyrolidone-modified polyvinyl alcohol, silicone-modified polyvinyl alcohol, silanol-modified polyvinyl alcohol, cation-modified polyvinyl alcohol, terminal alkyl-modified polyvinyl alcohol and the like; cellulose ethers and derivatives thereof such as hydroxyethyl cellulose, methyl cellulose, ethyl cellulose, carboxymethyl cellulose, acetyl cellulose and the like; starch such as starch, enzyme modified starch, thermochemically modified starch, oxidized starch, esterified starch, etherified starch (for example, such as hydroxyethyl starch), cationic starch and the like; polyacrylamides such as polyacrylamide, cationic polyacrylamides, anionic polyacrylamides, amphoteric polyacrylamides and the like; urethane resins such as polyester polyurethane resins, polyether polyurethane resins, polyurethane-based ionomer resin and the like; acrylic resin comprising (meth) acrylic acid and a monomer component (except olefin) copolymerizable with (meth) acrylic acid; styrene-butadiene resins such as styrene-butadiene copolymer, styrene-butadiene-acrylonitrile copolymer, styrene-butadiene-acrylic copolymer and the like; polyvinyl acetate; vinyl chloride-vinyl acetate copolymer; polyolefin resin such as ethylene-vinyl acetate copolymer; polyvinyl chloride; polyvinylidene chloride; polyacrylic ester resin; gum arabic, polyvinyl butylal, polystyrol and their copolymers; silicone resins; petroleum resins; terpene resins; ketone resins; cumaron resins and the like may be listed as examples. These may be used individually or as mixtures of at least two of them.

As a pigment used in the present invention, inorganic or organic fillers such as silica, calcium carbonate, kaolin, calcined kaolin, diatomaceous earth, talc, titanium oxide, aluminum hydroxide and the like may be cited. These may be used individually or as mixtures of at least two of them.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borate sand, boric acid, alum, ammonium chloride and the like may be listed as examples.

In addition, an image stabilizing agent that instills oil resistance in recorded images such as 4,4'-butylidene (6-t-butyl-3-methylphenol), 2,2'-di-t-butyl-5,5'-dimethyl-4,4'-sulfonyl diphenol, 1,1,3-tris (2-methyl-4-hydroxy-5-cyclohexylphenyl) butane, 1,1,3-tris (2-methyl-4-hydroxy-5-t-butylphenyl) butane, 4-benzyloxy-4'-(2,3-epoxy-2-methylpropoxy) diphenylsulfone and the like may also be added in the range that does not adversely affect the desired effects for the problems described above.

In addition, a benzophenone type and triazole type UV light absorption agent, dispersion agent, de-foaming agent, antioxidant, fluorescent dye and the like may also be used.

In the present invention, from 0.05 parts to 4.0 parts, preferably from 0.1 parts to 2.0 parts, of the color developing agent are ordinarily used per 1 part of the leuco dye. The types and amounts of sensitizer, binder, pigment, crosslinking agent, image stabilizing agent, and other optional ingredients are determined according to the required performance and printability and are not particularly restricted. However, from 0.1 parts to 10 parts of the sensitizer, from 0.5 parts to 50 parts of the pigment, from 0.01 parts to 10 parts of the image stabilizing agent and from 0.01 parts to 10 parts of the other ingredients are ordinarily used per 1 part of the leuco dye. The appropriate amount (in solid) of the binder is from 5 parts to 50 parts per 100 parts of the thermosensitive recording layer. The appropriate amount (in solid) of the slipping agent is from 5 parts to 10 parts per 100 parts of the thermosensitive recording layer.

The leuco dye, the color developing agent and materials added when needed are finely ground into particles, several microns or smaller in size, using a grinder or a suitable emulsification device such as a ball mill, attritor, sand grinder and the like, and a coating solution is prepared by adding a binder and various additive materials depending on the objective. Water, alcohol and the like can be used as the solvent for the coating solution and the solid content of the coating solution is about from 20 to 40 wt. %.

The protective layer may comprise the binder, the pigment, the crosslinking agent, and the other components usable for the aforementioned thermosensitive recording layer in range that does not adversely affect the desired advantages, but preferably comprises the binder and the pigment, and may further comprise the other components such as a surfactant and a viscosity adjusting agent.

As the binder to be used for the protective layer, polyvinyl alcohols and acrylic resins are preferred among the binders usable for the above-mentioned thermosensitive recording layer.

As the polyvinyl alcohols, completely saponified polyvinyl alcohol, carboxyl-modified polyvinyl alcohol, diacetone modified polyvinyl alcohol, acetoacetyl modified polyvinyl alcohol are preferred.

As the monomer component (except olefin) copolymerizable with (meth) acrylic acid of the acrylic resin, alkyl acrylate resins, such as methyl (meth) acrylate, ethyl (meth) acrylate, propyl (meth) acrylate, butyl (meth) acrylate, isobutyl (meth) acrylate, pentyl (meth) acrylate, hexyl (meth) acrylate, 2-ethyl hexyl (meth)acrylate, octyl (meth) acrylate, and the like; epoxy resins; silicone resins; modified alkyl acrylate resins, such as alkyl acrylate resin modified with styrene or its derivative; (meth) acrylonitrile; acrylic acid ester; hydroxyalkyl acrylic acid ester and the like may be listed. The monomer is preferably alkyl acrylate resins, such as methyl (meth) acrylic acid, ethyl (meth) acrylic acid, (meth) acrylic acid propyl, butyl (meth) acrylic acid, isobutyl (meth) acrylic acid, pentyl (meth) acrylate, hexyl (meth) acrylic acid, (meth) hexyl to acrylic acid-2-ethyl, octyl (meth) acrylic acid, and the like; epoxy resins; silicone resins; modified alkyl acrylate resins, such as alkyl acrylate resin modified with styrene or its derivative; (meth) acrylonitrile; acrylic acid ester; or hydroxyalkyl acrylic acid ester, more preferably the alkyl acrylate resins is (meth) acrylonitrile or methyl (meth) acrylic acid.

In order to improve the water resistance and the like, the protective layer may comprise a carboxyl group-containing resin as a binder and may further comprise a polyamine/polyamide resin.

As the carboxyl group-containing resin, the aforementioned carboxy-modified polyvinyl alcohol, acrylic resin, oxidized starch, carboxymethyl cellulose and the like are cited.

As the polyamine/polyamide resin, a polyamide urea resin, a polyalkylene polyamine resin, a polyalkylene polyamide resin, a polyamine polyurea resin, a modified polyamine resin, a modified polyamide resin, a polyalkylene polyamine urea formalin resin, a polyalkylene polyamine polyamide polyurea resin and the like are cited.

When the protective layer comprises a pigment in the present invention, silica, kaolin, calcined kaolin and aluminum hydroxide are preferred as the pigment, since the water resistance and the printing (recording) run-ability of the thermosensitive recording medium become better.

In the case when the protective layer of the present invention does not comprise a pigment, the amount (in solid) of the binder in the protective layer is usually from 70 to 100% by weight, preferably from 85 to 100% by weight.

On the other hand, when the protective layer of the present invention comprises a pigment, the total amount (in solid) of the binder and the pigment in the protective layer is usually from 80 to 100% by weight, preferably from 90 to 100% by weight and the amount of the binder is preferably 30 to 300 parts by weight per 100 parts by weight of the pigment.

The amount of the components other than the binder, the crosslinking agent and the pigment in the protective layer do not exceed 15% by weight, preferably 10% by weight.

The optional coating layers, other than the thermosensitive recording layer and the protective layer, may comprise aforementioned binder, pigments, crosslinking agents and the other components in the range that does not adversely affect the desired advantages.

The method for coating the thermosensitive recording layer, the protective layer and the other coating layer is not limited in particular, but any well-known conventional techniques may be used, such as curtain coating method, air knife coating method, bar blade coating method, rod blade coating method, bent blade coating method, bevel blade coating method, roll coating method, spray coating method and the like.

The coating amounts of the thermosensitive recording layer, the protective layer and the other coating layer are determined according to the required performance and printability and are not particularly restricted, but the typical dried coating amount of the thermosensitive recording layer is ordinarily in the range of from 2 to 12 g/m$^2$ and the typical dried coating amount of the protective layer is ordinarily in the range of from 1 to 5 g/m$^2$.

Furthermore, various technologies known in the thermosensitive recording medium field may be used as needed, for example, a flattening treatment such as super calendaring and the like can be conducted after coating each coating layer.

EXAMPLES

The following Examples illustrate the present invention, but the Examples are not intended to limit the scope of the present invention. In the following description, the terms parts and % indicate parts by weight and weight %, respectively.

The coating solutions and dispersions were prepared as described below.

Undercoat layer coating solution was prepared by dispersing and stirring the following formulation:

Undercoat Layer Coating Solution

| | |
|---|---|
| Calcined kaolin (BASF Co.: Ansilex 90) | 100.0 parts |
| Styrene-butadiene copolymer latex (Zeon Corporation, ST5526, solid content: 48%) | 10.0 parts |
| Water | 50.0 parts |

Color developing agent dispersions (Solutions A1 to A3) and leuco dye dispersions (Solutions B1 to B3) with the following formulations were separately wet ground using sand grinders until the average particle sizes were about 0.5 μm.

Color Developing Agent Dispersion (Solution A1)

| | |
|---|---|
| N-(2-(3-phenylureido)phenyl)benzenesulfonamide (Nippon Soda Co., Ltd. NKK 1304) | 6.0 parts |
| Aqueous solution of completely saponified polyvinyl alcohol (Kuraray Co., Ltd., PVA117, solid content: 10%) | 5.0 parts |
| Water | 1.5 parts |

Color Developing Agent Dispersion (Solution A2)

| | |
|---|---|
| 3-(3-Tosylureido)phenyl-p-toluenesulfonate (BASF Japan Ltd. DP 201) | 6.0 parts |
| Aqueous solution of completely saponified polyvinyl alcohol (PVA117) | 5.0 parts |
| Water | 1.5 parts |

Color Developing Agent Dispersion (Solution A3)

| | |
|---|---|
| 4-Hydroxy-4'-isopropoxydiphenylsulfone (Mitsubishi Chemical Corporation, NYDS) | 6.0 parts |
| Aqueous solution of completely saponified polyvinyl alcohol (PVA117) | 5.0 parts |
| Water | 1.5 parts |

Leuco Dye Dispersion (Solution B1)

| | |
|---|---|
| 3-Dibutylamino-6-methyl-7-anilinofluorane (Yamamoto Chemicals Inc., ODB-2) | 6.0 parts |
| Aqueous solution of completely saponified polyvinyl alcohol (PVA117) | 5.0 parts |
| Water | 1.5 parts |

Leuco Dye Dispersion (Solution B2)

| | |
|---|---|
| 3-(N-ethyl-N-isoamylamino)-6-methyl-7-anilinofluoran (Yamada Chemical Co., Ltd. S-205) | 6.0 parts |
| Aqueous solution of completely saponified polyvinyl alcohol (PVA117) | 5.0 parts |
| Water | 1.5 parts |

Leuco Dye Dispersion (Solution B3)

| | |
|---|---|
| 3-dipentylamino-6-methyl-7-anilinofluoran (Yamada Chemical Co., Ltd. BLACK305) | 6.0 parts |
| Aqueous solution of completely saponified polyvinyl alcohol (PVA117) | 5.0 parts |
| Water | 1.5 parts |

Next, these dispersions were blended in the proportion described below and were stirred until gluconolactone was completely dissolved, to prepare the thermosensitive recording layer coating solutions 1 and 2.

Thermosensitive Recording Layer Coating Solution 1

| | |
|---|---|
| Gluconolactone (referred to as "GDL") (Kanto Chemical Industry Co., Ltd. Special deer grade) | 1.0 parts |
| Leuco dye dispersion (Solution B1) | 10.0 parts |
| Silica dispersion (Mizusawa Industrial Chemicals, Ltd., Mizukasil P-537, solid content: 25%) | 20.0 parts |
| Zinc stearate dispersion (Chukyo Yushi Co., Ltd.: Hydrin L536, solid content: 40%) | 5.0 parts |
| Aqueous solution of completely saponified polyvinyl alcohol (PVA117) | 20.0 parts |

Thermosensitive Recording Layer Coating Solution 2

| | |
|---|---|
| Gluconolactone (referred to as "GDL") (Kanto Chemical Industry Co., Ltd. Special deer grade) | 0.44 parts |
| Color developing agent dispersion (Solution A1) | 0.92 parts |
| Leuco dye dispersion (Solution B1) | 1.05 parts |
| Silica dispersion (Mizusawa Industrial Chemicals, Ltd., Mizukasil P-537, solid content: 25%) | 5.0 parts |
| Zinc stearate dispersion (Chukyo Yushi Co., Ltd.: Hydrin L536, solid content: 40%) | 5.0 parts |
| Aqueous solution of completely saponified polyvinyl alcohol (PVA117) | 20.0 parts |

Next, protective layer coating solution 1 was prepared by mixing the following formulations:

Protective Layer Coating Solution 1

| | |
|---|---|
| Aluminum hydroxide dispersion (Martinsberg: Martifin OL, solid content: 50%) | 9.0 parts |
| Aqueous solution of acetoacetyl modified polyvinyl alcohol (Nippon Synthetic Chemical Industry Co., Ltd., Gohsenex Z-220, solid content 10%) | 30.0 parts |
| Zinc stearate dispersion (Chukyo Yushi Co., Ltd.: HydrinZ-7-30, solid content: 30%) | 2.0 parts |
| Water | 13.0 parts |

Example 1

The undercoat layer coating solution was applied on one side of a substrate (groundwood free paper with a basis weight of 47 g/m$^2$) by using a bent blade coater with a coating amount (in solid) of 10.0 g/m$^2$, and was dried to prepare an undercoated paper.

The thermosensitive recording layer coating solution 1 (GDL in total color developing agent is 100 weight %, GDL in the thermosensitive recording layer is 6.6 weight %, ratio of color developing agent/leuco dye is 0.21) was applied on the undercoat layer of the undercoated paper by using a rod blade coater with a coating amount (in solid) of 6.0 g/m$^2$ and was dried and super calendared so that the smoothness was 500-1,000 seconds to prepare a thermosensitive recording medium.

Example 2

A thermosensitive recording medium was prepared in the same manner as described in Example 1 using GDL 0.79 parts and the color developing agent dispersion (Solution A1) 0.41 parts in place of GDL 1.0 parts (i.e. GDL in total color developing agent is 80 weight %, GDL in the thermosensitive recording layer is 5.2 weight %, ratio of color developing agent/leuco dye is 0.20) in the thermosensitive recording layer coating solution 1.

Example 3

A thermosensitive recording medium was prepared in the same manner as described in Example 1 using GDL 0.59 parts and the color developing agent dispersion (Solution A1) 0.82 parts in place of GDL 1.0 parts (i.e. GDL in total color developing agent is 60 weight %, GDL in the thermosensitive recording layer is 3.9 weight %, ratio of color developing agent/leuco dye is 0.20) in the thermosensitive recording layer coating solution 1.

Example 4

A thermosensitive recording medium was prepared in the same manner as described in Example 1 using GDL 0.5 parts and the color developing agent dispersion (Solution A1) 1.04 parts in place of GDL 1.0 parts (i.e. GDL in total color developing agent is 50 weight %, GDL in the thermosensitive recording layer is 3.3 weight %, ratio of color developing agent/leuco dye is 0.21) in the thermosensitive recording layer coating solution 1.

Example 5

A thermosensitive recording medium was prepared in the same manner as described in Example 1 using GDL 0.4 parts and the color developing agent dispersion (Solution A1) 1.24 parts in place of GDL 1.0 parts (i.e. GDL in total color developing agent is 40 weight %, GDL in the thermosensitive recording layer is 2.6 weight %, ratio of color developing agent/leuco dye is 0.21) in the thermosensitive recording layer coating solution 1.

Example 6

A thermosensitive recording medium was prepared in the same manner as described in Example 1 using GDL 0.2 parts and the color developing agent dispersion (Solution A1) 1.66 parts in place of GDL 1.0 parts (i.e. GDL in total color developing agent is 20 weight %, GDL in the thermosensitive recording layer is 1.3 weight %, ratio of color developing agent/leuco dye is 0.21) in the thermosensitive recording layer coating solution 1.

Example 7

A thermosensitive recording medium was prepared in the same manner as described in Example 1 using GDL 1.04 parts and the color developing agent dispersion (Solution A1) 1.09 parts in place of GDL 1.0 parts (i.e. GDL in total color developing agent is 67 weight %, GDL in the thermosensitive recording layer is 6.6 weight %, ratio of color developing agent/leuco dye is 0.33) and adding water 1.4 parts in the thermosensitive recording layer coating solution 1.

Example 8

A thermosensitive recording medium was prepared in the same manner as described in Example 1 using GDL 1.09 parts and the color developing agent dispersion (Solution A1) 2.27 parts in place of GDL 1.0 parts (i.e. GDL in total color developing agent is 50 weight %, GDL in the thermosensitive recording layer is 6.6 weight %, ratio of color developing agent/leuco dye is 0.45) and adding water 2.7 parts in the thermosensitive recording layer coating solution 1.

Example 9

A thermosensitive recording medium was prepared in the same manner as described in Example 1 using GDL 0.76 parts and the color developing agent dispersion (Solution A1) 1.58 parts in place of GDL 1.0 parts (i.e. GDL in total color developing agent is 50 weight %, GDL in the thermosensitive recording layer is 6.6) and changing the amount of the leuco dye dispersion (Solution B1) from 10.0 parts to 1.8 parts (i.e. ratio of color developing agent/leuco dye is 1.76) in the thermosensitive recording layer coating solution 1.

Example 10

A thermosensitive recording medium was prepared in the same manner as described in Example 1 using GDL 0.59 parts and the color developing agent dispersion (Solution A2) 0.82 parts in place of GDL 1.0 parts (i.e. GDL in total color developing agent is 60 weight %, GDL in the thermosensitive recording layer is 3.9 weight %, ratio of color developing agent/leuco dye is 0.20) in the thermosensitive recording layer coating solution 1.

Example 11

A thermosensitive recording medium was prepared in the same manner as described in Example 1 using GDL 0.76 parts and the color developing agent dispersion (Solution A2) 1.58 parts in place of GDL 1.0 parts (i.e. GDL in total color developing agent is 50 weight %, GDL in the thermosensitive recording layer is 6.6) and changing the amount of leuco dye dispersion (Solution B1) from 10.0 parts to 1.8 parts (i.e. ratio of color developing agent/leuco dye is 1.76) in the thermosensitive recording layer coating solution 1.

Example 12

A thermosensitive recording medium was prepared in the same manner as described in Example 1 using GDL 0.4 parts and the color developing agent dispersion (Solution A2) 1.24 parts in place of GDL 1.0 parts (i.e. GDL in total color developing agent is 40 weight %, GDL in the thermosensitive recording layer is 2.6 weight %, ratio of color developing agent/leuco dye is 0.21) in the thermosensitive recording layer coating solution 1.

Example 13

A thermosensitive recording medium was prepared in the same manner as described in Example 1 using GDL 0.59 parts and the color developing agent dispersion (Solution A3) 0.82 parts in place of GDL 1.0 parts (i.e. GDL in total color developing agent is 60 weight %, GDL in the thermosensitive recording layer is 3.9 weight %, ratio of color developing agent/leuco dye is 0.20) in the thermosensitive recording layer coating solution 1.

Example 14

A thermosensitive recording medium was prepared in the same manner as described in Example 1 using leuco dye dispersion (Solution B2) in place of leuco dye dispersion (Solution B1) (i.e. ratio of color developing agent/leuco dye is 0.21) in the thermosensitive recording layer coating solution 1.

Example 15

A thermosensitive recording medium was prepared in the same manner as described in Example 1 using leuco dye dispersion (Solution B3) in place of leuco dye dispersion (Solution B1) (i.e. ratio of color developing agent/leuco dye is 0.21) in the thermosensitive recording layer coating solution 1.

Example 16

A thermosensitive recording medium was prepared in the same manner as described in Example 1 changing the amount of GDL from 10.0 parts to 2.16 parts (i.e. GDL in total color developing agent is 100 weight %, GDL in the thermosensitive recording layer is 13.2 weight %, ratio of color developing agent/leuco dye is 0.45) and adding water 3.5 parts in the thermosensitive recording layer coating solution 1.

Example 17

A thermosensitive recording medium was prepared in the same manner as described in Example 1 changing the amount of GDL from 10.0 parts to 3.53 parts (i.e. GDL in total color developing agent is 100 weight %, GDL in the thermosensitive recording layer is 19.9 weight %, ratio of color developing agent/leuco dye is 0.74) and adding water 7.1 parts in the thermosensitive recording layer coating solution 1.

Example 18

The undercoat layer coating solution was applied on one side of a substrate (groundwood free paper with a basis weight of 47 g/m$^2$) by using a bent blade coater with a coating amount (in solid) of 10.0 g/m$^2$, and was dried to prepare an undercoated paper.

The thermosensitive recording layer coating solution 2 (GDL in total color developing agent is 50 weight %, GDL in the thermosensitive recording layer is 6.6 weight %, ratio of color developing agent/leuco dye is 1.75) was applied on the undercoat layer of the undercoated paper by using a rod blade coater with a coating amount (in solid) of 6.0 g/m$^2$ and was dried and super calendared so that the smoothness was 500-1,000 seconds to prepare a thermosensitive recording layer coated paper.

Then the protective layer coating solution 1 was applied on the thermosensitive recording layer by using a rod blade coater with a coating amount (in solid) of 3.0 g/m$^2$ and was dried and super calendared so that the smoothness was 1500-2,000 seconds to prepare a thermosensitive recording medium.

Comparative Example 1

A thermosensitive recording medium was prepared in the same manner as described in Example 1 using L-ascorbic acid (Wako Pure Chemical Industries, Ltd. Special grade) 1.0 parts in place of GDL 1.0 parts (i.e. ratio of color developing agent/leuco dye is 0.21) in the thermosensitive recording layer coating solution 1.

Comparative Example 2

A thermosensitive recording medium was prepared in the same manner as described in Example 1 using citric acid (Wako Pure Chemical Industries, Ltd. Special grade) 1.0 parts in place of GDL 1.0 parts (i.e. ratio of color developing agent/leuco dye is 0.21) in the thermosensitive recording layer coating solution 1.

The thermosensitive recording media obtained were evaluated as described below.

<Whiteness>

The whiteness of the thermosensitive recording surface was measured by using a spectrophotometer (Murakami Color Research Laboratory Co., Ltd., CMS-35 SPX) according to JIS P 8148, immediately after preparation of the thermosensitive recording medium and after standing under conditions of 23 degree C. and 50% RH for 2 weeks.

<Color Development Sensitivity (Recorded Density)>

The prepared thermosensitive recording medium was printed (Relative brightness: +15, Printing speed: 50.8 mm/sec (2 inches/sec) by using a label printer (140XiIII manufactured by Zebra Co., Ltd.). The density of the recorded image was measured by using Macbeth Densitometer (RD-914, with Amber filter).

<Thermal Resistance>

The prepared thermosensitive recording medium was printed (Relative brightness: +15, Printing speed: 50.8 mm/sec (2 inches/sec) by using a label printer (140XiIII manufactured by Zebra Co., Ltd.).

The printed samples were placed in an environment at 60 degree C. for 8 hours then left standing under conditions of 23 degree C. and 50% RH for 3 hours.

The color density of the printed area of the samples were measured by using Macbeth Densitometer (RD-914, with Amber filter) to calculate the residual ratio from the difference between the color densities before and after the treatment. The thermal resistance was evaluated on the following criteria. If the residual ratio is 60% or more, no problem happens in the practical use.

Residual ratio=[developed color intensity after the treatment/developed color intensity before the treatment]×100(%)

<Hygrothermal Resistance>

The prepared thermosensitive recording medium was printed (Relative brightness: +15, Printing speed: 50.8 mm/sec (2 inches/sec) by using a label printer (140XiIII manufactured by Zebra Co., Ltd.).

The printed samples were placed in an environment at 40 degree C. and 90% RH for 8 hours then left standing under conditions of 23 degree C. and 50% RH for 3 hours.

The color density of the printed area of the samples were measured by using Macbeth Densitometer (RD-914, with Amber filter) to calculate the residual ratio from the difference between the color densities before and after the treatment. The hygrothermal resistance was evaluated on the following criteria. If the residual ratio is 60% or more, no problem happens in the practical use.

Residual ratio=[developed color intensity after the treatment/developed color intensity before the treatment]×100(%)

<Water Resistance>

The prepared thermosensitive recording medium was printed (Relative brightness: +15, Printing speed: 50.8 mm/sec (2 inches/sec) by using a label printer (140XiIII manufactured by Zebra Co., Ltd.).

The printed samples were immersed in water at 23 degree C. for 24 hours, then were air dried.

The color density of the printed area of the air dried samples were measured by using Macbeth Densitometer (RD-914, with Amber filter) to calculate the residual ratio from the difference between the color densities before and after the treatment. The water resistance was evaluated on the following criteria. If the residual ratio is 60% or more, no problem happens in the practical use.

Residual ratio=[developed color intensity after the treatment/developed color intensity before the treatment]×100(%)

The evaluation results are shown in Table 1.

TABLE 1

| | Color developing agent | | | | | | |
|---|---|---|---|---|---|---|---|
| | Amount in thermosensitive recording layer (%) | | | | | | |
| | Gluconolactone | Color developing agent with urea structure | Others | Gluconolactone/others | Leuco dye | Color developing agent/Leuco dye | Protective layer |
| Example 1 | 6.6% | — | — | 100/0 | ODB2 | 0.21 | — |
| Example 2 | 5.2% | NKK1304 1.3% | — | 80/20 | ODB2 | 0.20 | — |
| Example 3 | 3.9% | NKK1304 2.6% | — | 60/40 | ODB2 | 0.20 | — |
| Example 4 | 3.3% | NKK1304 3.3% | — | 50/50 | ODB2 | 0.21 | — |
| Example 5 | 2.6% | NKK1304 3.9% | — | 40/60 | ODB2 | 0.21 | — |
| Example 6 | 1.3% | NKK1304 5.2% | — | 20/80 | ODB2 | 0.21 | — |
| Example 7 | 6.6% | NKK1304 3.3% | — | 67/33 | ODB2 | 0.33 | — |
| Example 8 | 6.6% | NKK1304 6.6% | — | 50/50 | ODB2 | 0.45 | — |
| Example 9 | 6.6% | NKK1304 6.6% | — | 50/50 | ODB2 | 1.76 | — |
| Example 10 | 3.9% | DP201 2.6% | — | 60/40 | ODB2 | 0.20 | — |
| Example 11 | 6.6% | DP201 6.6% | — | 50/50 | ODB2 | 1.76 | — |
| Example 12 | 2.6% | DP201 3.9% | — | 40/60 | ODB2 | 0.21 | — |
| Example 13 | 3.9% | — | NYDS 2.6% | 60/40 | ODB2 | 0.20 | — |
| Example 14 | 6.6% | — | — | 100/0 | S-205 | 0.21 | — |
| Example 15 | 6.6% | — | — | 100/0 | BLACK305 | 0.21 | — |
| Example 16 | 13.2% | — | — | 100/0 | ODB2 | 0.45 | — |
| Example 17 | 19.9% | — | — | 100/0 | ODB2 | 0.74 | — |
| Example 18 | 6.6% | NKK1304 6.6% | — | 50/50 | ODB2 | 1.75 | installed |
| Comparative Example 1 | — | — | L-ascorbic acid 6.5% | 0/100 | ODB2 | 0.21 | — |
| Comparative Example 2 | — | — | Citric acid 6.5% | 0/100 | ODB2 | 0.21 | — |

TABLE 1-continued

| | Evaluation results | | | | | |
|---|---|---|---|---|---|---|
| | Whiteness ISO-B | | | Thermal | Hygrothermal | Water |
| | immediately after preparation | after 2 weeks | Color development sensitivity | Resistance (residual ratio) | Resistance (residual ratio) | Resistance (residual ratio) |
| Example 1 | 85% | 84% | 1.00 | 72% | 80% | 87% |
| Example 2 | 84% | 83% | 1.19 | 84% | 93% | 86% |
| Example 3 | 84% | 84% | 1.31 | 91% | 95% | 86% |
| Example 4 | 84% | 84% | 1.35 | 92% | 95% | 86% |
| Example 5 | 85% | 84% | 1.43 | 94% | 95% | 88% |
| Example 6 | 85% | 84% | 1.43 | 94% | 96% | 88% |
| Example 7 | 84% | 83% | 1.35 | 90% | 95% | 85% |
| Example 8 | 85% | 84% | 1.45 | 94% | 96% | 89% |
| Example 9 | 85% | 84% | 1.41 | 92% | 94% | 89% |
| Example 10 | 84% | 84% | 1.28 | 89% | 82% | 85% |
| Example 11 | 84% | 83% | 1.42 | 94% | 96% | 93% |
| Example 12 | 84% | 83% | 1.45 | 94% | 95% | 91% |
| Example 13 | 84% | 84% | 1.23 | 91% | 88% | 82% |
| Example 14 | 83% | 82% | 0.90 | 79% | 81% | 84% |
| Example 15 | 88% | 88% | 0.86 | 67% | 85% | 87% |
| Example 16 | 84% | 82% | 0.95 | 69% | 76% | 85% |
| Example 17 | 83% | 80% | 0.91 | 62% | 68% | 81% |
| Example 18 | 86% | 85% | 1.38 | 93% | 94% | 93% |
| Comparative Example 1 | 83% | 78% | 1.00 | 71% | 80% | 88% |
| Comparative Example 2 | 85% | 85% | 1.01 | 33% | 55% | 64% |

As shown in Table 1, gluconolactone alone exhibits almost the same performance as ascorbic acid as a color developing agent, while gluconolactone shows a better result in the decrease in whiteness over time than that of ascorbic acid alone (Example 1 vs Comparative Example 1). Citric acid alone shows almost the same Color development sensitivity (Recorded density) as gluconolactone alone, while citric acid alone shows inferior thermal resistance and water resistance to gluconolactone (Example 1 vs Comparative Example 2).

Further, when gluconolactone is used in combination with other color developing agent, the performance as a thermosensitive recording medium is better than gluconolactone alone, although the advantage of being environment-friendly decreases (Example 1 vs Comparative Examples 2-13).

In particular, when gluconolactone is used in combination with a color developing agent having a urea structure, it shows a superior performance (in particular, color development property) (Example 13 vs Examples 3 and 10).

What is claimed is:

1. A thermosensitive recording medium having a thermosensitive recording layer comprising a colorless or pale colored electron donating leuco dye and an electron accepting color developing agent on a substrate, wherein the thermosensitive recording layer comprises a gluconolactone as the electron accepting color developing agent.

2. The thermosensitive recording medium of claim 1, wherein the solid content of the gluconolactone in the thermosensitive recording layer is from 1 to 18 weight %.

3. The thermosensitive recording medium of claim 1, wherein the weight ratio of the electron accepting color developing agent to the electron donating leuco dye is from 0.05 to 4.0.

4. The thermosensitive recording medium of claim 1, further comprising a color developing agent having a urea structure (—NHCONH—) as the electron accepting color developing agent.

5. The thermosensitive recording medium of claim 4, wherein the weight ratio of the gluconolactone to the color developing agent having a urea structure (—NHCONH—) in the electron accepting color developing agent is 40/60 or more.

6. The thermosensitive recording medium of claim 2, wherein the weight ratio of the electron accepting color developing agent to the electron donating leuco dye is from 0.05 to 4.0.

7. The thermosensitive recording medium of claim 2, further comprising a color developing agent having a urea structure (—NHCONH—) as the electron accepting color developing agent.

8. The thermosensitive recording medium of claim 7, wherein the weight ratio of the gluconolactone to the color developing agent having a urea structure (—NHCONH—) in the electron accepting color developing agent is 40/60 or more.

9. The thermosensitive recording medium of claim 3, further comprising a color developing agent having a urea structure (—NHCONH—) as the electron accepting color developing agent.

10. The thermosensitive recording medium of claim 9, wherein the weight ratio of the gluconolactone to the color developing agent having a urea structure (—NHCONH—) in the electron accepting color developing agent is 40/60 or more.

* * * * *